US008707866B2

(12) United States Patent
Jeter

(10) Patent No.: US 8,707,866 B2
(45) Date of Patent: Apr. 29, 2014

(54) RAIL GUIDE MOUNTING ASSEMBLY FOR MANDREL TRIP APPARATUS

(76) Inventor: James M. Jeter, Jacksonville, FL (US)

( * ) Notice: Subject to any disclaimer, the term of this patent is extended or adjusted under 35 U.S.C. 154(b) by 213 days.

(21) Appl. No.: 13/426,211

(22) Filed: Mar. 21, 2012

(65) Prior Publication Data

US 2013/0247785 A1 Sep. 26, 2013

(51) Int. Cl.
*B41F 17/22* (2006.01)

(52) U.S. Cl.
USPC ..... 101/38.1; 101/40; 101/247

(58) Field of Classification Search
USPC ..... 101/38.1, 39, 40, 40.1, 247; 198/441, 198/471.1, 487.1
See application file for complete search history.

(56) References Cited

U.S. PATENT DOCUMENTS 3,356,019 A 12/1967 Zurick
3,563,170 A 2/1971 Cvacho et al.
3,665,853 A 5/1972 Hartmeister et al.
3,851,579 A 12/1974 Zurick
4,018,151 A 4/1977 Urban et al.
4,037,530 A 7/1977 Sirvet
4,140,053 A 2/1979 Skrypek et al.
4,267,771 A 5/1981 Stirbis
4,370,943 A 2/1983 Watanabe et al.
4,441,418 A 4/1984 Hahn
4,491,613 A 1/1985 Hahn
4,889,050 A 12/1989 Meador
5,111,742 A 5/1992 Didonato et al.
5,233,922 A 8/1993 Stirbis et al.
5,370,047 A 12/1994 Compton
5,572,927 A 11/1996 Sirvet
5,799,574 A 9/1998 Williams et al.
5,970,865 A 10/1999 Horth et al.
6,167,805 B1 1/2001 Williams et al.
6,651,552 B1 11/2003 Didonato
6,840,166 B2 1/2005 Jeter et al.

*Primary Examiner* — Leslie J Evanisko
(74) *Attorney, Agent, or Firm* — The Livingston Firm; Edward M. Livingston, Esq.; Bryan L. Loeffler, Esq.

(57) ABSTRACT

An independent mandrel trip system wherein a mandrel support block retaining a mandrel is connected to a shaft mounting block in a manner such that the mandrel support block can be reciprocatingly retracted and extended relative to the shaft mounting block in a direction perpendicular to the longitudinal axis of the mandrel. The system includes parallel front and rear plate members to which are mounted linear bearing assemblies such that mandrel support block is supported in the front and the rear.

18 Claims, 5 Drawing Sheets

RAIL GUIDE MOUNTING ASSEMBLY FOR MANDREL TRIP APPARATUS

BACKGROUND OF THE INVENTION

The invention relates generally to the field of equipment that incorporates multiple mandrels for temporarily receiving work pieces upon which a process must be performed, where it is sometimes necessary to quickly retract or reposition a mandrel. More particularly, the invention relates to such equipment wherein the mandrel needs to be retracted in a direction perpendicular to the longitudinal axis of the mandrel.

A mandrel is typically a cylindrical member used to retain another object during a processing operation. For example, in equipment used in the printing of beverage cans, a large number of freely rotating mandrels are mounted about the perimeter of a large rotating drum. A blank can is placed onto each mandrel at a loading station, and the drum then rotates the loaded mandrel past an applicator or printing mechanism, such as a rotating wheel having a series of inked printing blankets. The can loaded onto the mandrel contacts the printing blanket and ink is transferred in a precise manner. After inking, a varnish or lacquer is often applied as a sealant in the same manner. This type of equipment is designed to handle large quantities of cans in a very short time. For example, a typical decorating machine of the type described having from 24 to 36 equally spaced mandrels may produce over 2000 printings per minute.

In the event a can is not properly loaded onto a mandrel, ink or varnish will transfer onto the mandrel itself due to the thinness of the can wall and the minimal tolerances present in the equipment. If this occurs, ink or varnish will be transferred to the interior of the next blank can loaded onto the mandrel unless the equipment is shut down and cleaned. Where production totals of hundreds of thousands of cans per day are required, a shut down for even a few minutes is costly.

Because of this, when a blank can is not properly loaded onto a mandrel, the decorating machine is designed to detect this condition by known sensing means and to trigger a trip or can skip event. The trip event typically consists of the rotating applicator drum or the can handling component being shifted slightly away from the printing blanket component so that ink is not transferred onto an empty mandrel. In current equipment, a trip event may result in incomplete printing of 3 or more cans preceding and following the empty mandrel, such that these cans will be rejected by quality control. In addition, the current mechanism for enacting the trip event requires movement of large sections of the equipment, which entails complicated mechanisms that are susceptible to failure and wear. Examples of trip structures and systems designed to address the problem of unloaded or misloaded mandrels are shown in U.S. Pat. No. 3,665,853 to Hartmeister et al., U.S. Pat. No. 4,441,418 to Hahn, and U.S. Pat. No. 4,491,613 to Hahn, which show equipment wherein the applicator or printing means is retracted in response to occurrence of a trip event, and U.S. Pat. No. 3,563,170 to Cvacho et al., U.S. Pat. No. 3,851,579 to Zurick, U.S. Pat. No. 4,018,151 to Urban et al., U.S. Pat. No. 4,037,530 to Sirvet, and U.S. Pat. No. 4,140,053 to Skrypek et al., which show equipment wherein the mandrel support means is retracted in response to the trip event. These patents provide an overview of the general problem and descriptions of representative equipment found in the industry, and therefore the disclosure of these references is incorporated herein by reference.

A mandrel trip apparatus was disclosed in my U.S. Pat. No. 6,840,166, which addressed several problems inherent in the prior art at the time. The disclosure of this reference is incorporated herein by reference. This patent provides an independent mandrel trip apparatus having an operational mechanism of improved efficiency and durability, wherein a trip event only affects the non-loaded mandrel, in that each mandrel mounting block is provided with means to retract its mandrel without effect to the adjacent mandrels. In this patent, the mandrel support block retaining the mandrel is connected to a mounting block in a manner such that the mandrel support block can be reciprocatingly retracted and extended relative to the mounting block in a direction perpendicular to the longitudinal axis of the mandrel. A cam follower is connected to the mounting block, the mounting block being connected to the drum or plate by a pair of guide shafts positioned within guide bores disposed in the drum or plate, whereby the mounting block is able to reciprocate in the radial direction in response to movement of the cam follower.

In use the mandrel and the mandrel trip apparatus are subjected to high stress. Because the mandrels and mandrel trip apparatus are mounted to the plate member only on one end, the stresses are disproportionally distributed, such that the free end of the mandrel is susceptible to displacement from its optimum position. The disproportionate stresses can result in misalignment, the need for more frequent adjustment and repair, and eventual failure.

It is an object of this invention to provide a novel and improved assembly for such a mandrel trip apparatus, wherein the mechanism for connecting the mounting blocks to the drum or plate comprises linear bearing rail guides and linear guide rails. It is a further object to provide such an assembly wherein the mounting blocks are retained between a pair of plate members such that support is provided at both the front and rear.

SUMMARY OF THE INVENTION

The invention is a novel and improved mounting assembly for an independent mandrel trip apparatus such as used with cylindrical can decorating machines or other equipment utilizing multiple mandrels adapted to temporarily receive and retain work pieces, such as for example a blank can to be imprinted, where retraction or repositioning of individual mandrels from an active position to an inactive position is necessitated by certain events, such as the non-loading or misloading of a particular mandrel. Such a mandrel trip apparatus may comprise a two piece mandrel block assembly comprising a base block assembly and a mandrel support block assembly, wherein the base block assemblies of the mandrel trip apparatus are adapted to be mounted into base mounts positioned circumferentially about a rotating drum, plate or like member for properly positioning the mandrel for desired operations, such as printing or coating of a can mounted onto the mandrel for example, and wherein the upper block of the mandrel assembly is a mandrel support block retaining the mandrel itself. The base block assemblies and the mandrel support block assemblies are joined such that linear reciprocal movement of the mandrel support block assembly in the radial direction is possible relative to the base block assembly, such that the mandrel may be repositioned in a direction perpendicular to the longitudinal axis of the mandrel. In routine operation, the mandrel is disposed at the extended position, but in the event of a non-loading the trip system is activated such that the support mandrel block assembly and mandrel are retracted.

The mounting assembly comprises a base mount assembly that is adapted to be affixed to the base block assembly, the base mount assembly comprising a brace member mounted to a plate member, and most preferably mounted between a front and rear plate member, the plate members being mounted to a rotating shaft. The base mount further comprises front and rear bearing-containing rail guides mounted onto the brace member, the rail guides extending in the radial direction. The mounting assembly further comprises a rail support assembly comprising a mounting plate member and a depending plate member. The depending plate member is provided with front and rear bearing mounts or receptacles, and linear bearing rails are connected to the front and rear bearing mounts. The rail support member is received within the base mount by positioning the depending plate member between the rail guides such that the linear bearing rails are received within the rail guides. With this structure the base mount assembly is able to move radially inwardly and outwardly within the base mount assembly.

DETAILED DESCRIPTION OF THE INVENTION

Figure 1:
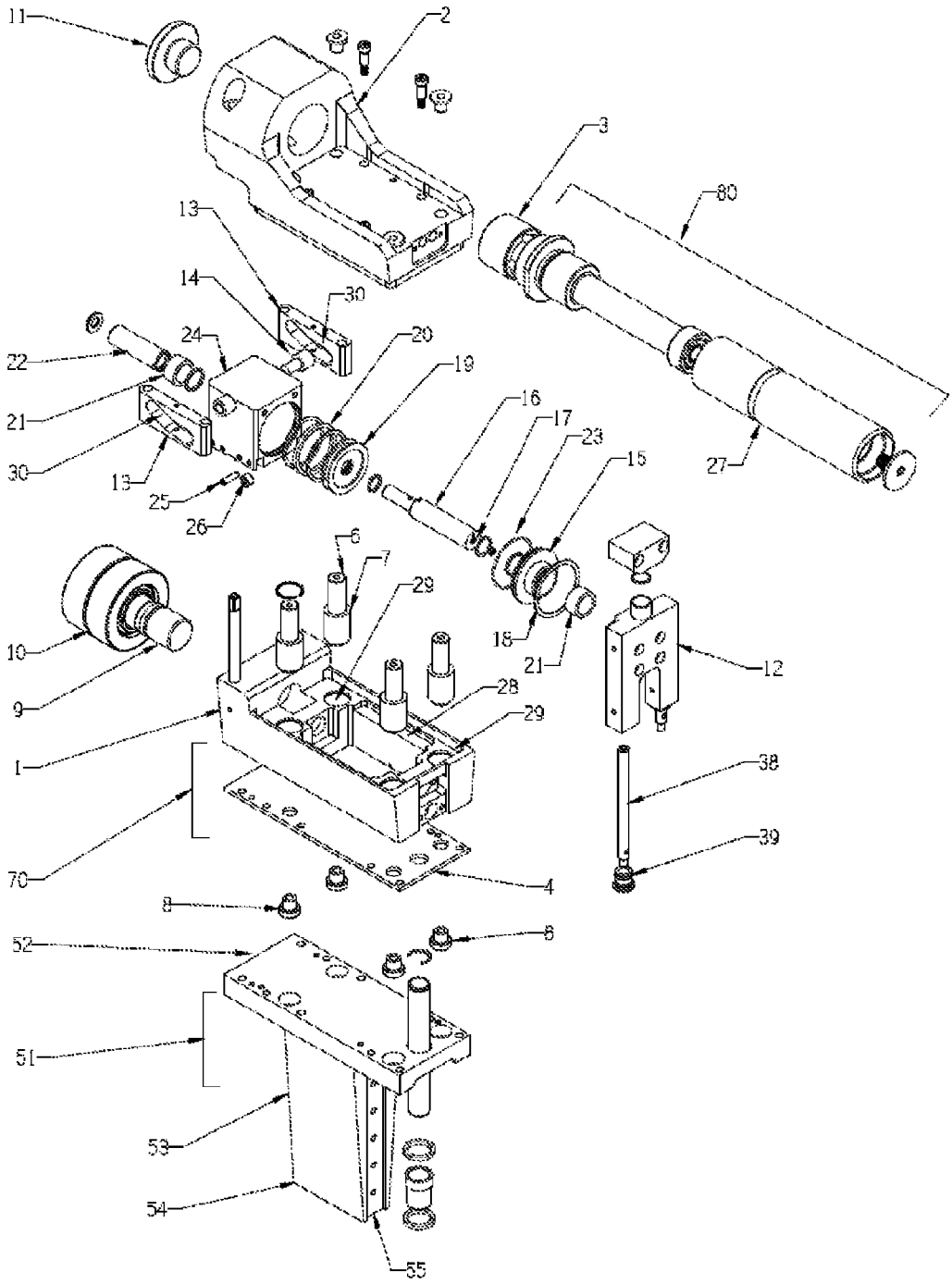
FIG. 1 is an exploded view of an embodiment of the invention shown in combination with a mandrel trip system.

With reference to the drawings, the invention will now be described in detail with regard for the best mode and the preferred embodiment or embodiments. In a most general sense, the invention is a rail guide mounting assembly for and/or in combination with a mandrel trip apparatus, assembly or system comprising trip means in the form of a mandrel block assembly to effectuate retraction or repositioning of a mandrel in a direction perpendicular to the longitudinal axis of the mandrel in response to a sensing of a trip event, the mandrel being adapted to temporarily receive a work piece thereon for subsequent processing. The mandrel block assembly comprises two main components, a base block assembly and a mandrel support block assembly, which are separable by mandrel support block movement means such that the separation distance between the base block assembly and the mandrel support block assembly is changed responsive to a trip event in order to retract the mandrel.

The rail guide mounting assembly comprises a base mount assembly 40 in combination with a rail support assembly 51, the base mount assembly 40 comprising a brace member 41 mounted to a plate member, and most preferably mounted to and between a front plate member 63 and a rear plate member 62, the plate members 62 and 63 being mounted to a rotating shaft 61 in parallel. The base mount assembly 40 further comprises bearing-containing front linear rail guides 43 and bearing-containing rear linear rail guides 42 mounted onto the brace member 41, onto the front and rear plate members 63 and 62, respectively, and/or onto bearing carrier blocks 44. The rail support assembly 51 comprises a mounting plate member 52 and a depending plate member 53, the mounting plate member 52 being disposed outwardly of the depending plate member 53, which extends inwardly toward the shaft 61. The mounting plate member 52 is adapted to be joined to the base block assembly 70. The depending plate member 53 is preferably provided with front bearing mounts, channels or receptacles 55 and rear bearing mounts, channels or receptacles 54, or other mechanical constructs suitable for retaining the linear bearings rails 56, and linear bearing rails 56 are connected to the front and rear bearing mounts 55 and 54. The rail support assembly 51 is received within the base mount assembly 40 by positioning the depending plate member 53 between the rail guides 42 and 43 such that the linear bearing rails 56 are received within the rail guides 42 and 43. With this structure the rail support assembly 51 and the base block assembly 70 are able to move radially inwardly and outwardly within the base mount assembly 40. Most importantly, the moment resulting from the mounting mechanism for the mandrel assembly 80 is reduced or eliminated, since the base block assembly 70 is supported in the rear by the rear plate member 62 in the front by the front plate member 63.

Figure 4:
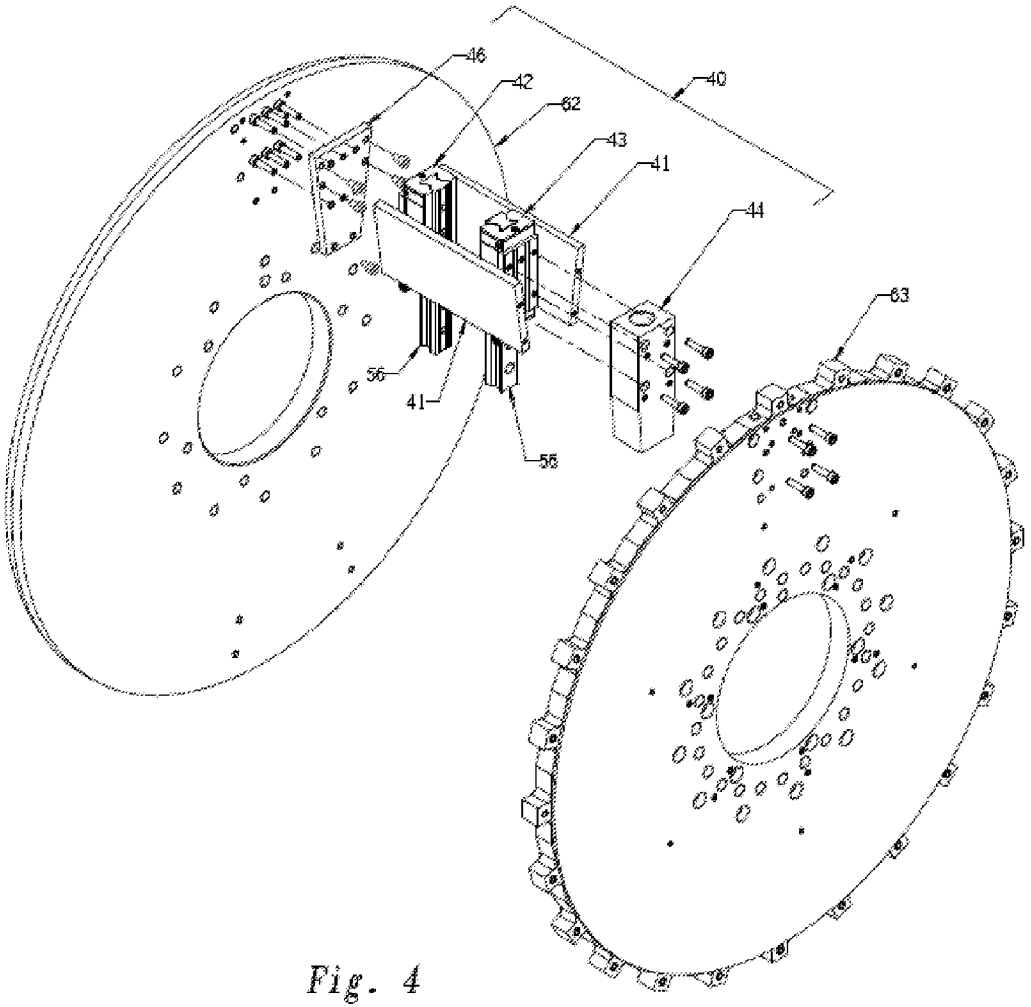
FIG. 4 is an exploded view of an embodiment of the invention shown in combination with the base mount assembly.
Figure 5:
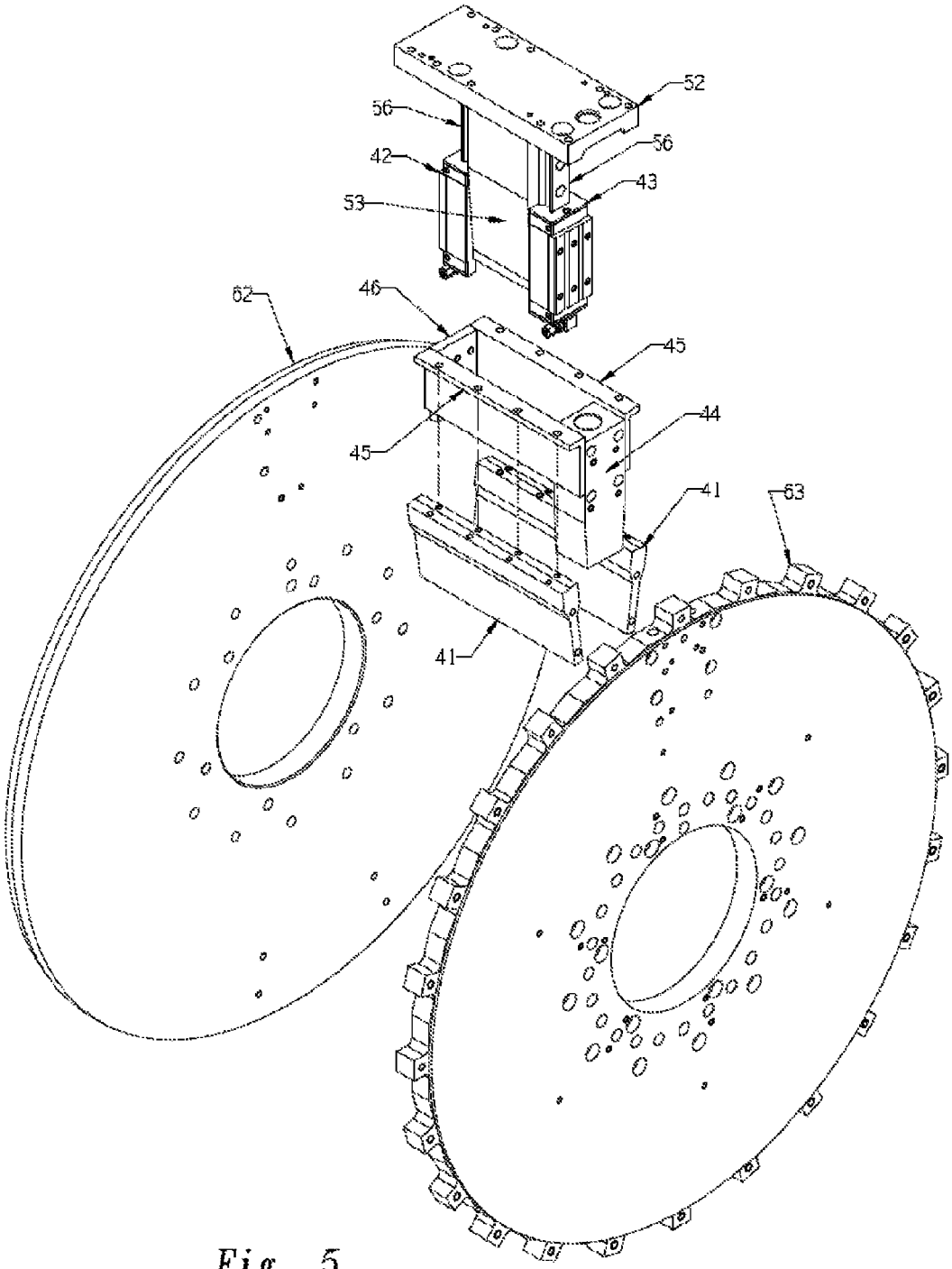
FIG. 5 is an exploded view of an embodiment of the invention shown in combination with the rail support assembly and the base mount assembly.

Alternative mounting strategies are illustrated in FIGS. 4 and 5. In FIG. 4, generally L-shaped in cross-section mounting flanges 45 are provided, the mounting flanges being adapted such that the outer portion rests upon paired brace members 41 and are fastened to the brace members 41 by mechanical fasteners inserted through apertures in the upper portion of the mounting flanges 45 aligned with bores disposed in the outer edges of the brace members 41. The mounting flanges 45 may be joined to the bearing carrier 44 and to a wall member 46 to form a more rigid construction that may be easily removed from the brace members 41. The assembly in FIG. 5 is similar to that of FIG. 2, with this embodiment comprising a wall member 46 affixed to the rear plate 62.

In the embodiments shown in the drawings, a shaft mounting block 1 having a generally L-shaped configuration in side view is secured to the mounting plate 52 of the rail support assembly 51 by suitable means, such as mechanical fasteners. The shaft mounting block 1 is provided with a generally rectangular central cavity 28 for receipt of the cylinder housing 24 and related elements. The shaft mounting block 1 is also provided with a plurality of bores 29 for receipt of guide bushings 7 and guide pins 6 which define the direction of movement of the mandrel support block 2. Stop nuts 8 are provided on the underside of the base plate 4 to limit travel distance of the mandrel support block 2. A cam roller shaft 9 and mounting block cam roller 10 extend from the rear of the shaft mounting block 1 to effectuate repositioning of the shaft mounting block 1 as required by the equipment.

Mandrel trip operator or actuator means, i.e., means to move the mandrel support block 2 relative to said shaft mounting block 1, are provided such that the mandrel support block 2 is reciprocatingly movable so as to be retractable and extendable relative to the shaft mounting block 1 in the direction perpendicular to the longitudinal axis of the mandrel shaft 3. The mandrel trip actuator means comprises a cylinder housing 24 mounted onto rollers 26 by roller pins 25 and placed within the generally rectangular cavity 28, such that the cylinder housing 24 is capable of reciprocal linear movement relative to the shaft mounting block 1, in the direction parallel to the central axis of the mandrel 27. The height of the cylinder housing 24 is such that it extends above and from the cavity 28. A fixed piston 19 having a piston seal 20 is positioned within and extending through the cylinder housing 24, the piston 19 mounted onto an inner cylinder shaft 22 and an outer cylinder shaft 16, which are retained within an assembly comprising a cylinder rod seal 23, a cylinder cap 15, a retaining ring 18, bushing 21 and cylinder shaft retainer 12. The piston 19 is aligned parallel to the longitudinal axis of the mandrel 27. In this manner the cylinder housing 24 is sealed such that fluid, whether hydraulic or pneumatic, cannot escape from the housing during reciprocal motion of the cylinder housing 24. A tube 17 is provided for fluid transfer, such as hydraulic fluid, air or the like, to either side of the stationary piston 19. Transfer of fluid from one side of the piston 19 to the other results in linear movement of the cylinder housing 24. Alternatively, the trip means can be electrically effectuated. Cylinder housing cam rollers 14 are provided on opposite sides of the cylinder housing 24, with the cylinder housing cam rollers 14 being positioned preferably outside of the cavity 28.

The mandrel support block 2 is mounted onto the guide pins 6 that are of a length sufficient to extend through the bores 29 of the shaft mounting block 1. The mandrel support block 2 retains a cylindrical mandrel 27 mounted onto a mandrel shaft 3 retained by a mandrel shaft retainer 11, with the mandrel 27 mounted in a manner that allows for free rotation about its longitudinal axis. A pair of cam slot flange members 13 are attached to the underside of the mandrel support block 2. A matching curved, slanted or angularly configured slot 30 is disposed in each flange member 13 to receive the cylinder cam rollers 26 mounted on the cylinder housing 24. The slots 30 of the cam slot members 13 are disposed such that one end is higher than the other relative to the plane containing the base plate 4. As shown in the figures, the forward end of the slots 30 are disposed higher than the rearward end, where the forward direction is taken to be the direction toward the free end of the mandrel 27.

In the normal extended and operational position, the cylinder housing 24 is linearly disposed rearward such that the cylinder cam rollers 26 are at the lower end of the cam slots 13. This position is held by fluid pressure within the cylinder housing 24, wherein the fluid is supplied in known manner through typical hydraulic or pneumatic systems. Appropriate fluid communication ports and conduits are provided to deliver fluid into the cylinder housing 24 in order to effect its linear movement relative to the fixed piston 19. This results in the mandrel support block 2 being retained in the extended position relative to the shaft mounting block 1, such that the separation between the mandrel support block 2 and the shaft mounting block 1 is at its greatest. In the event of trip event, wherein sensing means of known type sense the non-loading or misleading of a can or other work piece onto the mandrel 27, the pressure within the cylinder housing 24 is diverted to the opposite side of the fixed piston 19, causing the cylinder housing 24 to advance forward. As this occurs, the cylinder cam rollers 26 advance to occupy the raised end of the cam slots 30, which causes the mandrel support block 2 to lower or retract relative to the shaft mounting block 1. The retraction of the mandrel 27 in the direction perpendicular to its central axis provides sufficient separation between the surface of the mandrel 27 and the printing means, for example, whereby ink will not be transferred onto mandrel 27. Extension of the shaft mounting block 1 after the printing station is passed is effected by again reversing the pressure within the cylinder housing 24 relative to the fixed piston 9, such that the cylinder housing 24 retreats and the cylinder cam rollers 14 return to the lower end of the cam slots 30.

In this manner the mandrel 27 can be retracted independently of the other mandrels on the rotary drum. The mandrel support block 2 moves relative to the shaft mounting block 1, but the components are retained in precise alignment and the mandrel support block 2 is returned to the precise extended position after each trip event.

Figure 2:
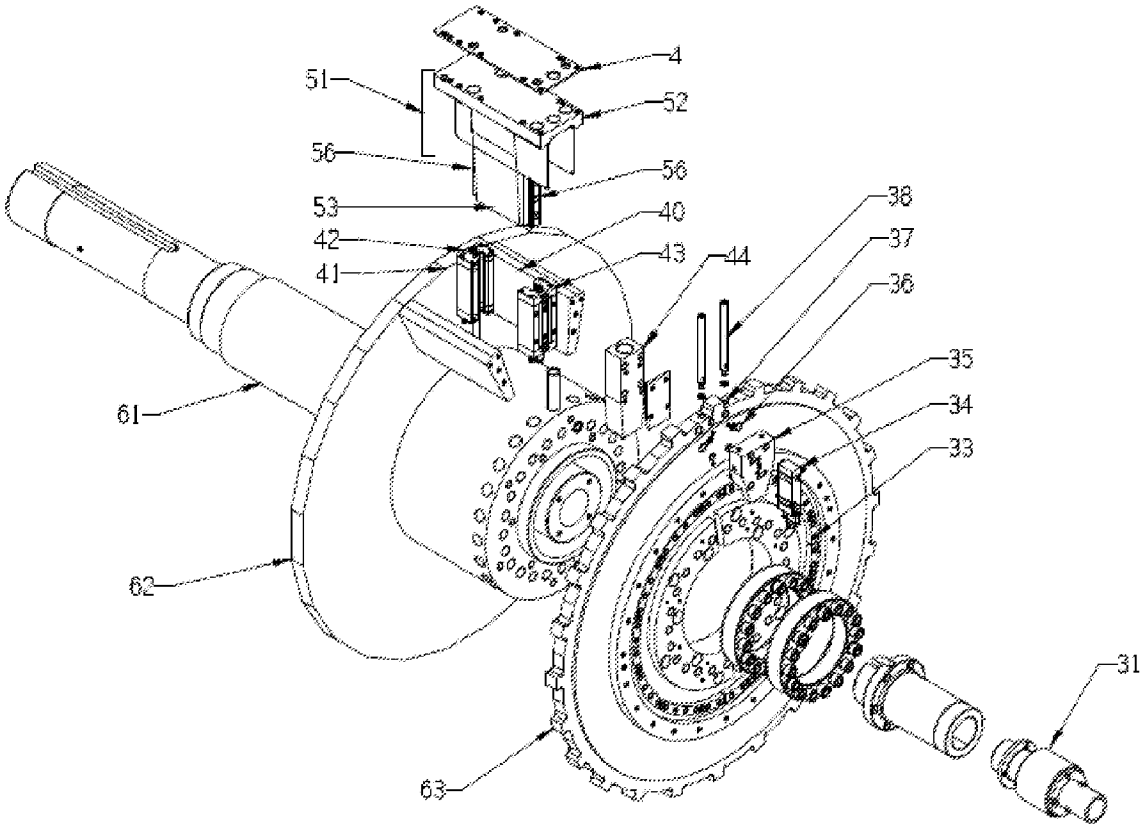
FIG. 2 is an exploded view of an embodiment of the invention shown in combination with the shaft and mounting plate members.
Figure 3:
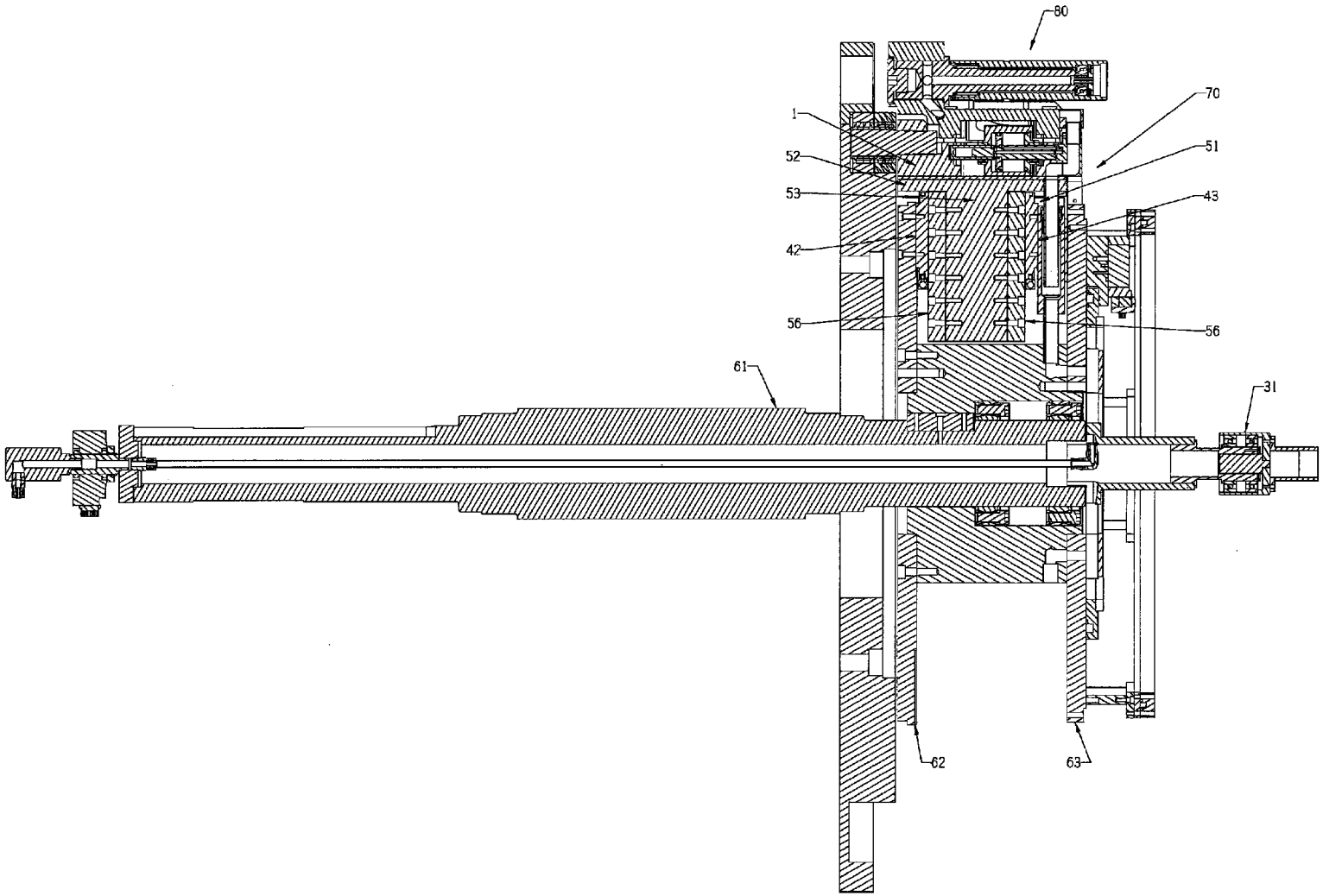
FIG. 3 is a cross-sectional view of an embodiment of the invention shown in combination with a mandrel trip system, shaft and the mounting plate members.

In a preferred embodiment, the pneumatic operation of the mandrel trip system is accomplished by providing a pneumatic assembly mounted onto the front plate 63, as shown in FIG. 2. An annular common air plenum 33 is positioned on the front plate 63. Valves 34 are mounted onto blocks 35 connected to the front plate 63, the valves being in pneumatic communication with the common air plenum 33 and with ports 36 extending into the front plate 63. The ports 36 intersect with radially oriented bores 37 that receive air delivery tubes 38. The air delivery tubes 38 are received within bores of the cylindrical shaft retainer 12 and bushings 39 are mounted onto the air delivery tubes 38 to act as seals. The bushings 39 are sized such that a small amount of air may escape from the cylindrical shaft retainer 12 during a trip event. This makes the assembly self-cleaning and self-cooling, since it is undesirable to utilize typical lubricants which may contaminate the equipment. The pneumatic assembly operates such that the mandrel assembly 80 is positioned in either the fully extended or the fully retracted position in the event no power is supplied to the mandrel trip assembly. Electrical power to the mandrel trip assembly is preferably provided by a slip ring assembly 31 that transfers power from the shaft 61 to solenoid valves.

It is contemplated that equivalents and substitutions to certain elements set forth above may be obvious to those skilled in the art without straying from the function and intent of the invention, and therefore the true definition and scope of the invention is to be as set forth in the following claims.

I claim:

1. A mandrel trip apparatus comprising:

a mandrel support block retaining a mandrel, said mandrel being cylindrical and having a longitudinal axis, wherein said mandrel support block is connected to a shaft mounting block in a manner such that said mandrel support block is reciprocatingly movable relative to the shaft mounting block in the direction perpendicular to said longitudinal axis of said mandrel;

mandrel trip actuator means comprising a piston and a cylinder housing receiving said piston, wherein said cylinder housing reciprocates in the direction parallel to said longitudinal axis of said mandrel;

a front plate member and a rear plate member mounted to a rotating shaft in parallel;

a rail guide mounting assembly comprising a base mount assembly and a rail support assembly, said rail support assembly connected to said shaft mounting block;

said rail support assembly comprising a depending plate member having front and rear bearing mounts each retaining linear bearing rails, said base mount assembly comprising bearing-containing front and rear linear rail guides receiving said linear bearing rails and at least one brace member mounted to said front and rear plate members, whereby said rail support assembly linearly reciprocates relative to said base mount assembly.

2. The apparatus of claim 1, wherein the at least one brace member comprises two brace members mounted to said front and rear plate members.

3. The apparatus of claim 2, wherein said front linear rail guide is mounted to said two brace members and said rear linear rail guide is mounted to said two brace members.

4. The apparatus of claim 2, said base mount assembly further comprising a pair of mounting flanges connected to said brace members.

5. The apparatus of claim 4, each of said mounting flanges being L-shaped in cross-section and having an upper portion with apertures, said brace members each having an edge having bores disposed in said edge, wherein said mounting flanges are mechanically connected to said brace members through said apertures and said bores.

6. The apparatus of claim 1, wherein said front linear rail guide is mounted to said front plate member and said rear linear rail guide is mounted to said rear plate member.

7. The apparatus of claim 1, wherein said front and rear linear rail guides are mounted to said at least one brace member.

8. The apparatus of claim 1, said base mount assembly further comprising at least one mounting flange, said at least one mounting flange being connected to said at least one brace member.

9. The apparatus of claim 8, said at least one mounting flange being L-shaped in cross-section and having an upper portion with apertures, said at least one brace member having an edge having bores disposed in said edge, wherein said at least one mounting flange is mechanically connected to said at least one brace member through said apertures and said bores.

10. In an apparatus comprising a cylindrical mandrel having a longitudinal axis and adapted to receive a work piece thereon upon which a process is to be effected, wherein it is required under certain conditions that the mandrel be reciprocatingly moved from an active position to an inactive position, the apparatus further comprising sensing means to actuate such reciprocal movement, the apparatus further comprising a mandrel support block retaining said mandrel and connected to a shaft mounting block in a manner such that said mandrel support block is reciprocatingly movable relative to the shaft mounting block in the direction perpendicular to said longitudinal axis of said mandrel, and further comprising a mandrel trip actuator means comprising a piston and a cylinder housing receiving said piston, wherein said cylinder housing reciprocates in the direction parallel to said longitudinal axis of said mandrel, the improvement comprising:

a front plate member and a rear plate member mounted to a rotating shaft in parallel;

a rail guide mounting assembly comprising a base mount assembly and a rail support assembly, said rail support assembly connected to said shaft mounting block;

said rail support assembly comprising a depending plate member having front and rear bearing mounts each retaining linear bearing rails, said base mount assembly comprising bearing-containing front and rear linear rail guides receiving said linear bearing rails and at least one brace member mounted to said front and rear plate members, whereby said rail support assembly linearly reciprocates relative to said base mount assembly.

11. The apparatus of claim 10, wherein the at least one brace member comprises two brace members mounted to said front and rear plate members.

12. The apparatus of claim 11, wherein said front linear rail guide is mounted to said two brace members and said rear linear rail guide is mounted to said two brace members.

13. The apparatus of claim 10, wherein said front linear rail guide is mounted to said front plate member and said rear linear rail guide is mounted to said rear plate member.

14. The apparatus of claim 10, wherein said front and rear linear rail guides are mounted to said at least one brace member.

15. The apparatus of claim 10, said base mount assembly further comprising at least one mounting flange, said at least one mounting flange being connected to said at least one brace member.

16. The apparatus of claim 15, said at least one mounting flange being L-shaped in cross-section and having an upper portion with apertures, said at least one brace member having an edge having bores disposed in said edge, wherein said at least one mounting flange is mechanically connected to said at least one brace member through said apertures and said bores.

17. The apparatus of claim 11, said base mount further comprising a pair of mounting flanges connected to said brace members.

18. The apparatus of claim 17, each of said mounting flanges being L-shaped in cross-section and having an upper portion with apertures, said brace members each having an edge having bores disposed in said edge, wherein said mounting flanges are mechanically connected to said brace members through said apertures and said bores.

* * * * *